United States Patent [19]

Reehil et al.

[11] 3,944,794

[45] Mar. 16, 1976

[54] COPYING SYSTEM CONTROL

[75] Inventors: Edward G. Reehil, Henrietta; James E. Summers, Fairport; Bhogilal M. Modi, Rochester, all of N.Y.

[73] Assignee: Xerox Corporation, Stamford, Conn.

[22] Filed: Dec. 5, 1972

[21] Appl. No.: 312,411

[52] U.S. Cl. ..... 235/92 SB; 235/92 R; 235/92 CT

[51] Int. Cl.[2] ..... G06B 27/06

[58] Field of Search ..... 235/92 SB, 92 CT

[56] References Cited

UNITED STATES PATENTS 3,588,472 6/1971 Glaster et al. ..... 235/92 SB

*Primary Examiner*—Joseph M. Thesz, Jr.

[57] ABSTRACT

A copying system incorporating means enabling the user to automatically recover from a jam or machine malfunction in the event the copy program is prematurely stopped with the result that some of the copies then in process are lost. A first counter means counts copies processed while a second counter means counts copies started. In the event of a premature stop, the second counter means is automatically reset to the same count as the first counter means thereby programming the system to make up copies lost as well as copies remaining on the original program. If the copying system includes a sorter, the second counter means is programmed to count copies when sorting is completed.

If the copying system has an automatic document handler, a third counter means records originals brought to the platen and a fourth counter means records originals whose copying has been completed. On a premature stop, a check is automatically made to determine whether or not the original on the platen at the time of the stop correctly matches the first of the copies lost. If not, restarting of the system is precluded while the document handler brings the correct original back to the platen following which the system is restarted, and a control is provided to inhibit restarting of the system except for recycling of the document handler until the malfunction is corrected.

6 Claims, 6 Drawing Figures

COPYING SYSTEM CONTROL

This invention relates to a document copying system, and more particularly to an improved document copying system capable of automatically making up copies lost due to a system malfunction while the copying program is being carried out.

As processing speeds of modern day copying or reproduction machines become faster and faster, and machine accessories such as sorters, collators, binders, document handlers, etc. become more and more prevalent, the problem of recouping or saving a specific job in the event of a machine malfunction, such as, for example, a paper jam, becomes almost impossible. It will be understood that protection against things like paper jams is provided through safety controls designed to stop, in the shortest possible time, the machine as well as any accessories used therewith. The jammed papers, which are usually damaged or mutilated, are then removed and the machine restarted. However, loss of these partially processed copies upsets the program, since, if the system is merely restarted, the number of copies made will not equal the number of copies programmed. This, of course, is due to the loss of some copies in clearing the machine.

Thus, to fulfill the original program, some provision for making up the copies lost as a result of clearing the jam must be made. Since there is usually a direct relationship between copies lost and the sequence in which the originals are copied, the most favorable time for factoring in the copies lost is at the time of the jam rather than after the program is completed. But doing this is difficult in modern high-speed copying machines, particularly those employing accessories such as a document handler, since it is so difficult to determine exactly how many copies are actually lost and to identify those copies lost with the correct original. Rather than go through a complicated evaluation, many users tend to simply start the entire program anew, writing off as a total loss copies made up to the time of the jam. This, of course, can be quite wasteful and expensive, particularly where the job is large and almost completed at the time of the jam.

It is a principal object of the present invention to provide a new and improved copier control.

It is a further object of the present invention to provide a copier control adapted following a premature stopping of the copier during a copy run to automatically reprogram the copier to compensate for copies lost or destroyed as a result of said premature stop.

It is an object of the present invention to provide an automatic copier programmer adapted in the event copies are lost during a copy run to reprogram the copier to add to the original program those copies lost.

It is a further object to provide a reproduction machine having an improved control mechanism designed, on a premature stopping of the machine during a production run, to determine, before restarting of the machine is permitted, whether or not the correct original is in copying position, and, if not, to inhibit restarting of the reproduction machine until the correct original is in copying position.

It is an object of the present invention to provide an improved control for an automatic document handler adapted for use with copiers effective on an interruption in the copying cycle to reprogram the document handler to assure that the document in copying position correctly matches the copy to be made.

It is an object of the present invention to provide an improved copier incorporating means adapted to prevent restarting of the copier in the event of a paper jam until the jam has been cleared.

It is a further object of the invention to provide a copier control effective to require, in the event of a paper feed jam, that the operator at least open up the paper feed transports before restarting of the copier is permitted.

It is an object of the present invention to provide a method of programming a reproduction machine to compensate for copies lost or destroyed as a result of a paper jam during a copy run.

This invention relates to a means to automatically reprogram a copying machine to produce the desired number of copies in the event a malfunction occurs during the program causing the machine to stop with resultant loss in a not readily discernible number of copies which may be then in process, the combination comprising: document handling means for feeding individual documents to be copied to the copying machine platen and following copying to clear the platen for the next document in accordance with a predetermined program; counter means adapted to maintain a running count of copies in process so that in the event of premature stopping of the machine, the number of copies then in process are known; means adapted following a premature stop of the copying machine to automatically reprogram the copying machine in response to the counter means count to add to the copying machine program copies equal to the number of copies in process at the time of the premature stop whereby to make up for copies lost as a result of the premature stop; control means for the document handling means adapted on the premature stop of the copying machine to recycle the document handling means in the event the document on the platen does not correspond to the first copy to be made under the copying machine reprogramming; and means to inhibit restarting of the copying machine until the correct document is fed to the copying machine platen by the document handling means.

Other objects and advantages will be apparent from the following description and drawings in which:

FIG. 1*a* is a schematic sectional view of an electrostatic type reproduction machine embodying the improved control means of the present invention;

FIG. 1*b* is a schematic sectional view of a portion of the reproduction machine of FIG. 1*a* and a portion of a collating apparatus adapted for receiving and collating finished copies from the reproduction machine.

Figure 4B:
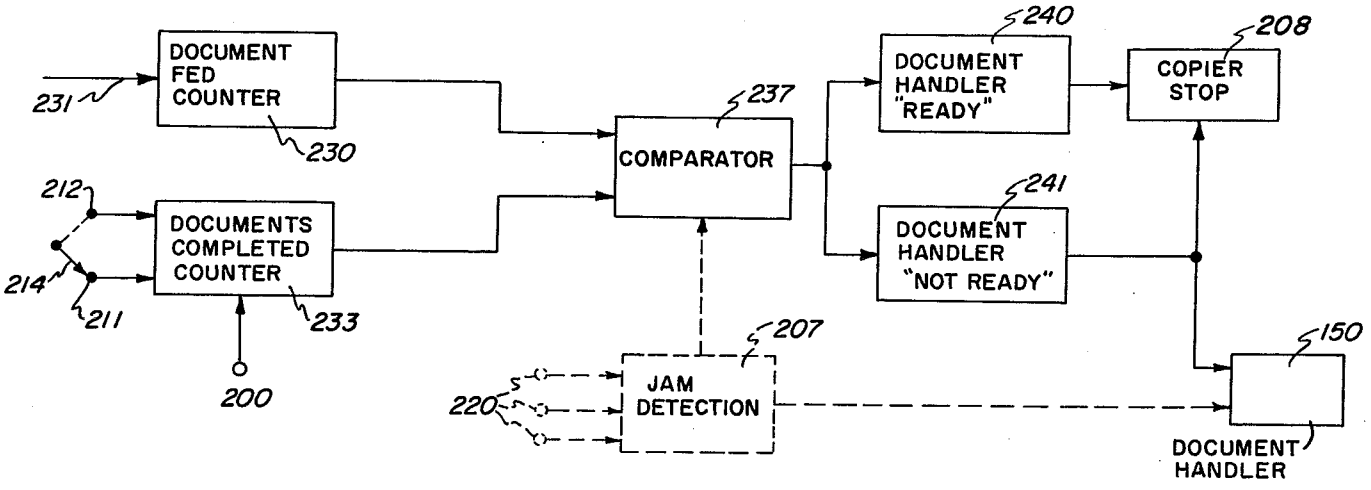
Figure 4A:
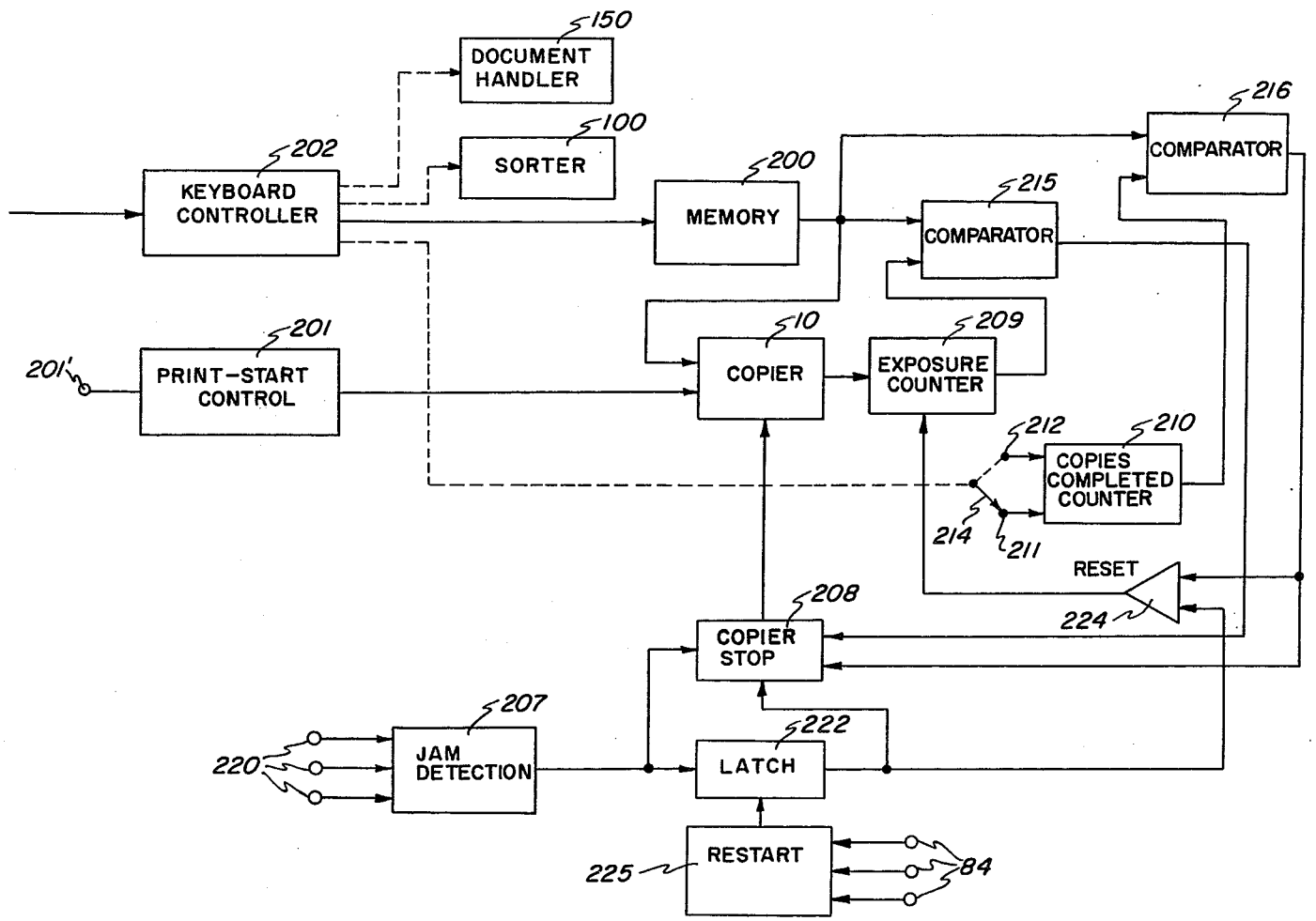

FIG. 4*a* is a schematic circuit representation of the improved control means of the present invention; and FIG. 4*b* is a schematic circuit representation of the improved control means illustrating the circuit additions to the control of FIG. 4*a* necessitated by the addition of an automatic document handler to the reproduction system.

Figure 1A:
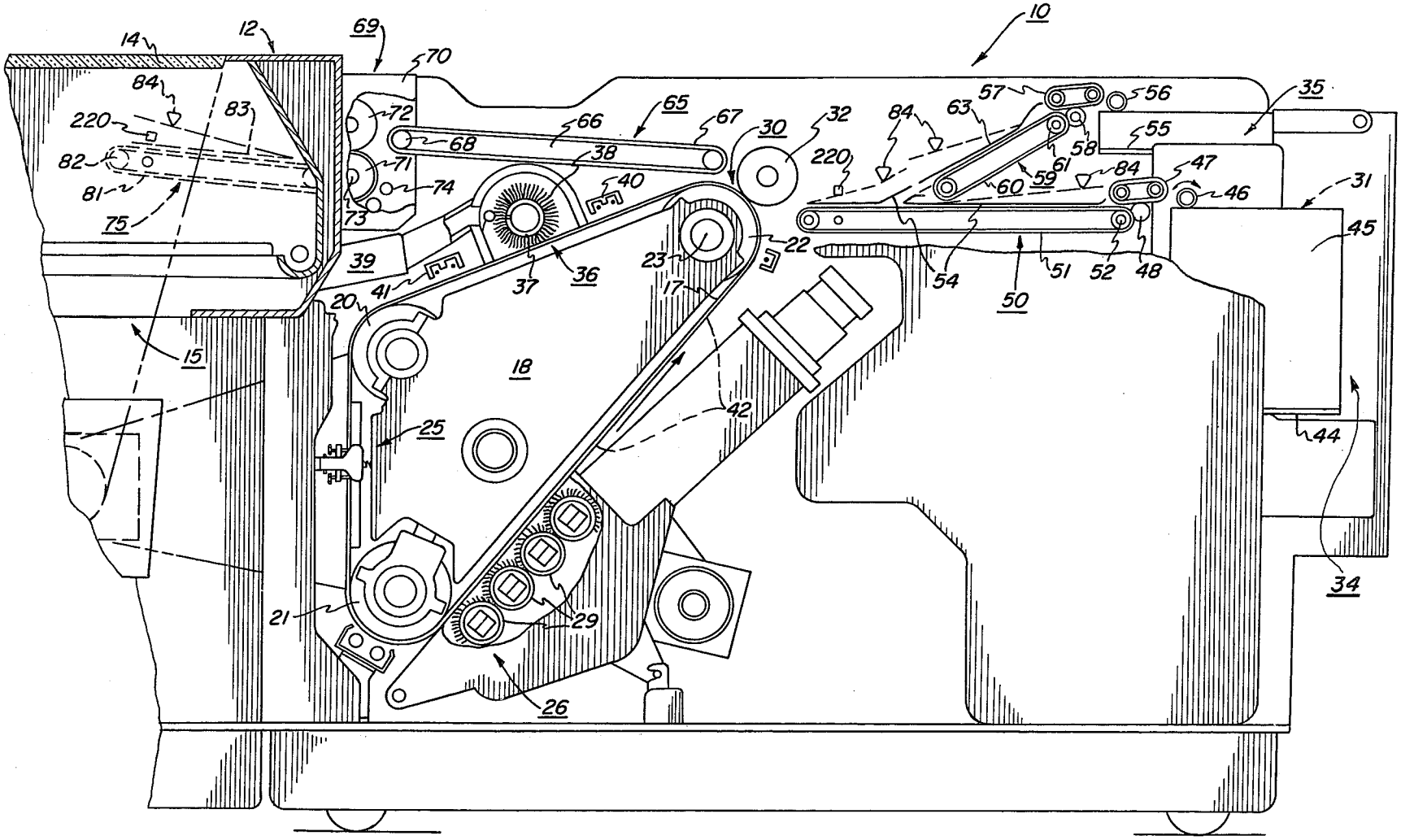
Figure 1B:
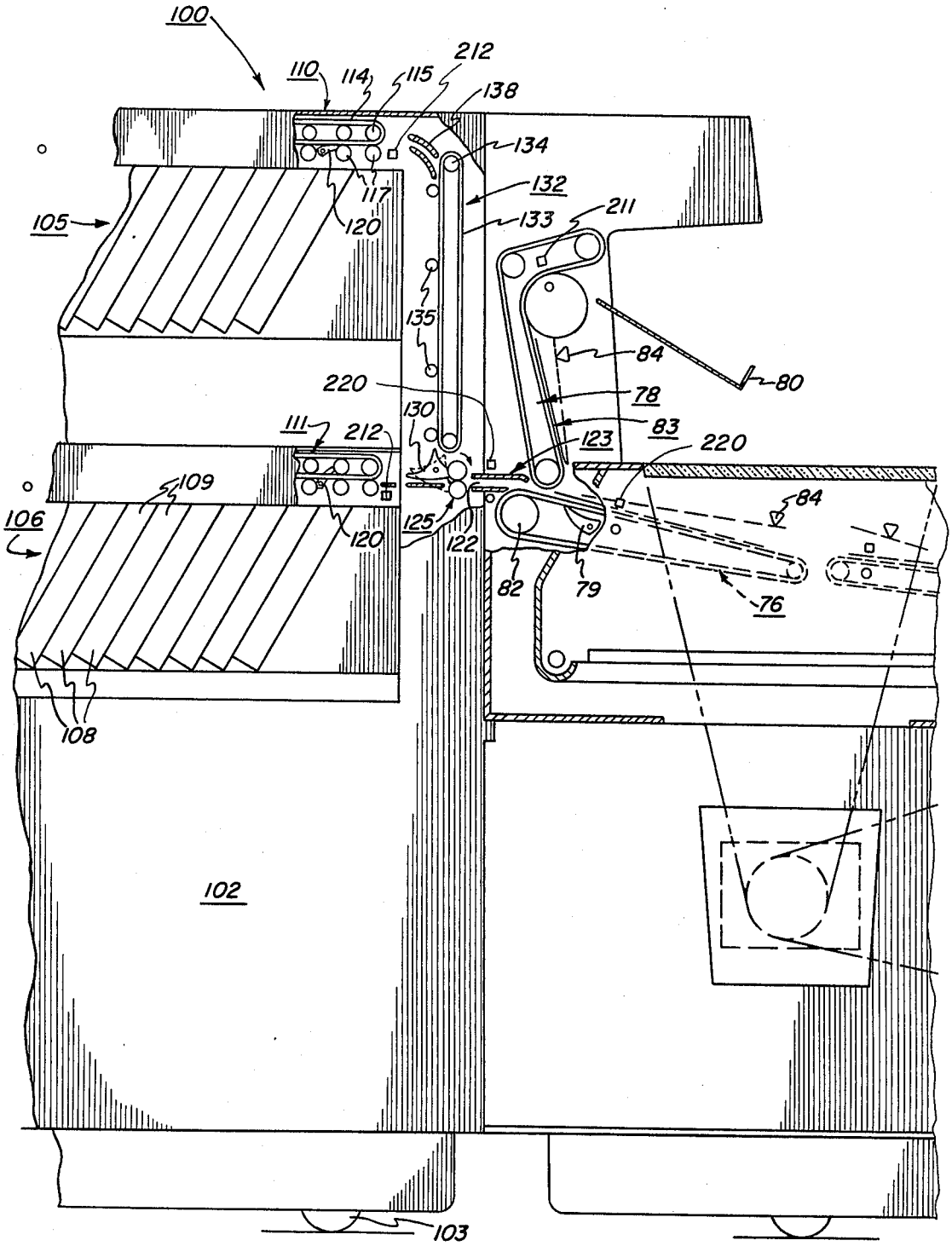
Figure 2:
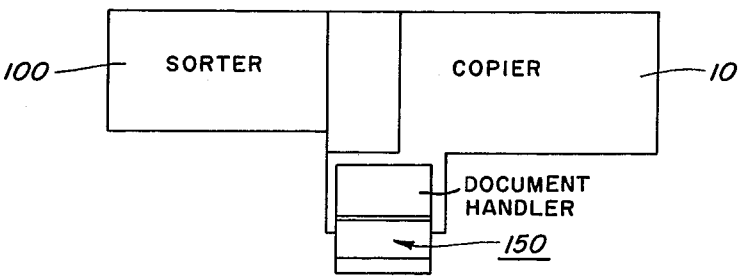
FIG. 2 is a top view of the reproduction machine shown in FIG. 1.

Referring particularly to FIGS. 1 and 2 of the drawings, an exemplary copier/reproduction machine, designated generally by the numeral 20, and incorporating the automatic program or job recovery arrangement of the present invention, is shown. As in all electrostatic systems such as the xerographic type machine illustrated, a light image of a document to be reproduced is projected onto the sensitized surface of a xerographic plate to form an electrostatic latent image thereon. Thereafter, the latent image is developed with an oppositely charged developing material to form a xerographic powder or toner image, corresponding to the latent image on the plate surface. The toner image is then electrostatically transferred to a support surface where it is fused by a fusing device so that the toner image is permanently adhered to the support surface.

In the copier 10, an original document 12 to be copied is placed upon a transparent platen 14 fixedly arranged in an illumination assembly, generally indicated by the reference numeral 15, and disposed at one end of the copier 10. While upon the platen, the document 12 is illuminated, thereby producing image rays corresponding to the informational areas on the original. The image rays are projected by means of an optical system onto the photosensitive surface of a xerographic plate. In the exemplary copier/reproduction machine 10, the xerographic plate is in the form of a flexible photoconductive belt 17 supported in a belt assembly 18.

The support assembly 18 for photoconductive belt 17 includes three rollers 20, 21 and 22 located with parallel axes at approximately the apices of a triangle. The upper roller 22 is rotatably supported on shaft 23 which in turn is rotatably driven by a suitable motor and drive means (not shown) to drive belt 17 in the direction shown by the arrow in FIG. 1. During this movement of the belt, the reflected light image of the original document 12 on platen 14 is flashed upon the photoreceptor surface of belt 17 at an exposure station 25 to produce an electrostatic latent image thereon.

The electrostatic image is carried on belt 17 from exposure station 25 through developing station 26 where the latent electrostatic image is developed by means of toner through the use of a multiple magnetic brush system 29. From developer station 26, the now developed image on belt 17 moves to transfer station 30 where the developed image is transferred to a support surface, normally a sheet of copy paper 31, brought from main or auxiliary paper trays 34 or 35, respectively, as will appear. The copy sheet 31 passes between transfer roller 32 and belt 17 at transfer station 30 at a speed substantially equal to the speed of belt 17, transfer taking place by means of electrical bias on transfer roller 32 in a manner understood by those skilled in the art.

Following transfer, the belt 17 is cleaned in preparation for the next image at cleaning station 36. There, a suitable cleaning brush 37 housed in vacuum chamber 38 removes residual toner, the toner being drawn from chamber 38 by vacuum through line 39 for deposit in a suitable collecting place (not shown). To assist cleaning a cleaning corotron 40 is provided upstream of vacuum chamber 38.

Following cleaning of belt 17, the belt 17 is once again charged as by charging corotron 41 in preparation for the next image.

It will be understood that whenever copier 10 is operated to make multiple copies, a number of images 42 may be on belt 17 simultaneously in various process stages as described above.

Photoconductive belt 17 comprises a photoconductive layer of selenium, which is the light receiving surface and image medium for the apparatus, on a conductive backing. Further details regarding the structure of the belt assembly and its relationship with the machine and support therefor may be found in the copending applications Ser. No. 102,312 filed Dec. 29, 1970, now U.S. Pat. No. 3,730,623, commonly assigned with the instant application.

Copy sheets 31 are supplied from either main paper tray 34 or auxiliary paper tray 35. Main paper tray 34 includes a suitable elevator type base 44 on which a supply 45 of sheets 31 rest, base 44 being supported for automatic up and down movement by suitable means (not shown) designed to maintain paper feed roll 46 in operative contact with the topmost one of the sheets 31 on elevator 44. Feed roll 46, which is operated intermittently in the direction shown by the solid line arrow in timed relationship to the spacing of images 42 on belt 17, serves to advance the topmost sheet from supply stack 45 into the nip of belt and feed roll pair 47, 48, respectively, which in turn carry the sheet onto main paper supply transport 50.

Transport 50 includes one or more endless feed belts 51 stretched about support rollers 52, one or both of which are suitably driven. Sheet guides 54 are disposed in operative position above transport belts 51, guides 54 serving to maintain the sheets 31 in operative contact with belt 51 of paper supply transport 50 during movement therealong. Transport 50 carries the sheets 31 forward to transfer roll 32.

Auxiliary tray 35, in the exemplary arrangement shown, is arranged above main tray 34, auxiliary tray 35 including a suitable elevator type base 55 on which a supply of sheets 31 may be provided. As with main supply tray 34 suitable means (not shown) are provided to raise base 55 of auxiliary tray 35 as the supply of sheets thereon are used up so as to maintain the paper feed roll 56 for auxiliary tray 35 in operative contact with the topmost sheet. Paper feed roll 56, which is intermittently driven in the same manner as main tray feed roll 46, advances one sheet at a time into the nip of belt and roller feed pair 57, 58 which in turn carry the sheets forward to auxiliary paper supply transport 59. Transport 59 which comprises one or more endless belts 60 stretched about support rollers 61, one or both of which are suitably driven, is disposed to discharge sheets 31 drawn from auxiliary tray 35 onto the operating run of main supply transport 50. The sheets 31 from auxiliary tray 35 are thereafter fed to transfer roll 32. Guides 63 serve to maintain the sheets in driving contact with the auxiliary paper supply transport 59 during movement therealong.

Transfer roll 32 is provided with a suitable bias designed to electrostatically attract and attach sheets 31 thereto. In this way, the sheets 31 discharged from main supply transport 50 are carried by transfer roller 32 past belt 17 and in spaced but operative relationship therewith to vacuum transport 65. It is understood that transfer of the image from belt 17 to copy sheet 31 takes place as the sheet 31 passes between transfer roller 32 and belt 17.

Following transfer, the copy sheet 31 is stripped from belt 17 by suitable means (not shown), the image bearing sheets being carried by vacuum transport 65 to a fuser 69. Transport 65 includes a vacuum plenum 66 to which vacuum is supplied from a suitable source (not shown). Transport 65 includes an endless conveyor belt 67 arranged about rollers 68, belt 67 having suitable perforations therethrough which enable vacuum from plenum 66 to tack the sheets 31 being fed thereto.

Fuser 69 includes a suitable housing 70 within which is disposed a lower heated fuser roll 71 and an upper pressure roll 72, rolls 71, 72 cooperating to form a nip through which the copy sheets 31 pass. Rolls 71, 72 are suitably supported for rotation and driven in unison by a suitable drive means (not shown). Pressure roll 72 is comprised of a relatively soft rubber like material with the result that pressure contact between the rolls 71, 72 deforms the surface of pressure roll 72. In this way, an increased contact arc between the copy sheet and the heated fuser roll 71 is obtained.

In the exemplary arrangement illustrated, fuser roll 71 is hollow, roll 71 being formed from a suitable heat conductive material. A source of heat such as lamp 73 is disposed therewithin. A suitable temperature variable resistor, i.e. thermistor 74 is supported on the fuser housing 70 in heat exchange relation therewith to sense temperature conditions within fuser 69. Suitable control circuitry (not shown) for controlling fuser lamp 73 in response to fuser temperature conditions as sensed by thermistor 74 is provided.

Copy sheets 31 leaving fuser 69 are carried by intermediate copy output transport 75 to copy output transport 76 and from transport 76 to either copy discharge transport 78 or to the inlet of a copy sheet handling device such as the sorter 100. Where sorter 100 is not in use or where no sheet handling device is provided a blocking gate 79 serves to route all copies onto discharge transport 78. Discharge transport 78 carries the copies to output tray 80.

Copy output transports 75, 76 and copy discharge transport 78 each have one or more endless conveyor belts 81 operatively disposed about support rollers 82 therefor, one or both of which may be driven. Guides 83 are disposed in operative relationship with each of the transports 75, 76, 78, guides 83 serving to maintain the copy sheets in operative contact with the conveyor belts associated therewith.

Guides 54, 63, 83 are releasably supported to enable their respective transports to be cleared in the event of a jam. Sensors 84, disposed in operative relationship with the guides 54, 63, 83 for transports 50, 59, 75, 76, 78, serve to prove release of the guides by the user following a jam, restarting of the copying machine 10 being precluded until sensors 84 are activated by opening of the guides 54, 63, 83 as will appear.

In the exemplary arrangement shown in FIG. 1*b*, a sorter 100 is operatively coupled to copier 10. Sorter 100 serves to sort copies 31 as they egress from copier 10. Sorter 100 includes a suitable frame 102 which is preferably mounted on castors 103 to facilitate moving sorter 100 about. Sorter 100 includes upper and lower copy bin rows 105, 106 respectively. Each row 105, 106 contains a plurality of spaced downwardly inclined bins or trays 108 for receiving and holding copies being sorted, each bin 108 being open at the top to provide an inlet 109 through which the copies pass into the bin.

A generally horizontal copy sheet transport 110, 111 is spacedly disposed above each row 105, 106 of bins 108 opposite inlets 109 thereto, the operating length of transports 110, 111 being sufficient to enable transports 110, 111 to carry the copies to the endmost one of the bins. Transports 110, 111 each comprise one or more endless conveyor belts 114 supported on rollers 115, one or both of which may be driven by a suitable means (not shown). A series of idler rolls 117 are arranged below and in operative contact with the lower operating run of transports 110, 111, an idler roll 117 being provided adjacent the inlet 109 to each bin 108. Idler rollers 117 serve both to hold the copies in operative contact with the transport conveyor belts 114 and as a base about which copies are born by the adjoining deflector 120 into the inlet 109 bin therebelow. An individually actuable deflector 120 is arranged slightly downstream of each roller 117. When actuated to a raised position, the deflectors 120 cooperate with the surface of the roller 117 to turn a copy from the sheet transport 110 or 111 associated therewith into bin 108 therebelow.

Sorter 100 includes a copy sheet inlet 122 formed by sheet guide pair 123, the height of sorter inlet 122 being approximately the same as the operating height of copier discharge transport 76. In this way copies from discharge transport 76 pass into sorter 100 and are sorted thereby, it being understood that in this mode of operation gate 79 of copier 10 is in the down position.

A sorter feed roll pair 125 are provided adjacent the discharge side of inlet guide 123. Roll pair 125, which are driven in the direction shown by the solid line arrow of the drawings, serve to carry the copy forward into the sorter 100. A movable sorter inlet deflector 130 is provided just downstream of roll pair 125, deflector 130 serving when in the solid line position shown in the drawings to direct the copies to transport 111 and lower bin row 106.

To enable the copy sheets 31 to be fed to transport 110, and upper bin row 105, an elevator transport 132 is provided. Transport 132 comprises one or more endless belts 133 supported by roll pair 134, one or both of which are driven by suitable means (not shown). A series of idler rollers 135 are disposed in contact with the operating run of transport belt 134, rolls 135 serving to hold the copy sheets on transport 132. Vertical transport 132 is disposed just downstream of roller pair 125 and in operative relationship with deflector 130 such that deflector 130 when moved to the dotted line position shown in the drawings, serve to route the copy sheet 31 emerging from roll pair 125 onto transport 132.

A curved paper guide pair 138 is operatively disposed between the upper discharge end of transport 132 and the inlet to upper transport 110. Guide pair 138 serves to turn the copy sheets leaving transport 132 through an arc of approximately 90° to upper bin transport 110.

During use, copy sheets 31 leaving copier 10 enter inlet 122 of sorter 100 and are forwarded by roll pair 125 to either lower bin transport 111 or to elevator transport 132 depending on the position of deflector 130. Copy sheets routed onto transport 132 are carried upwardly thereby to upper bin transport 110. Copy sheets 31 from either transport 110 or 111 are routed into selected bins 108 of either upper or lower bins rows 105, 106, respectively, through selective actuation of deflectors 120.

Figure 3:
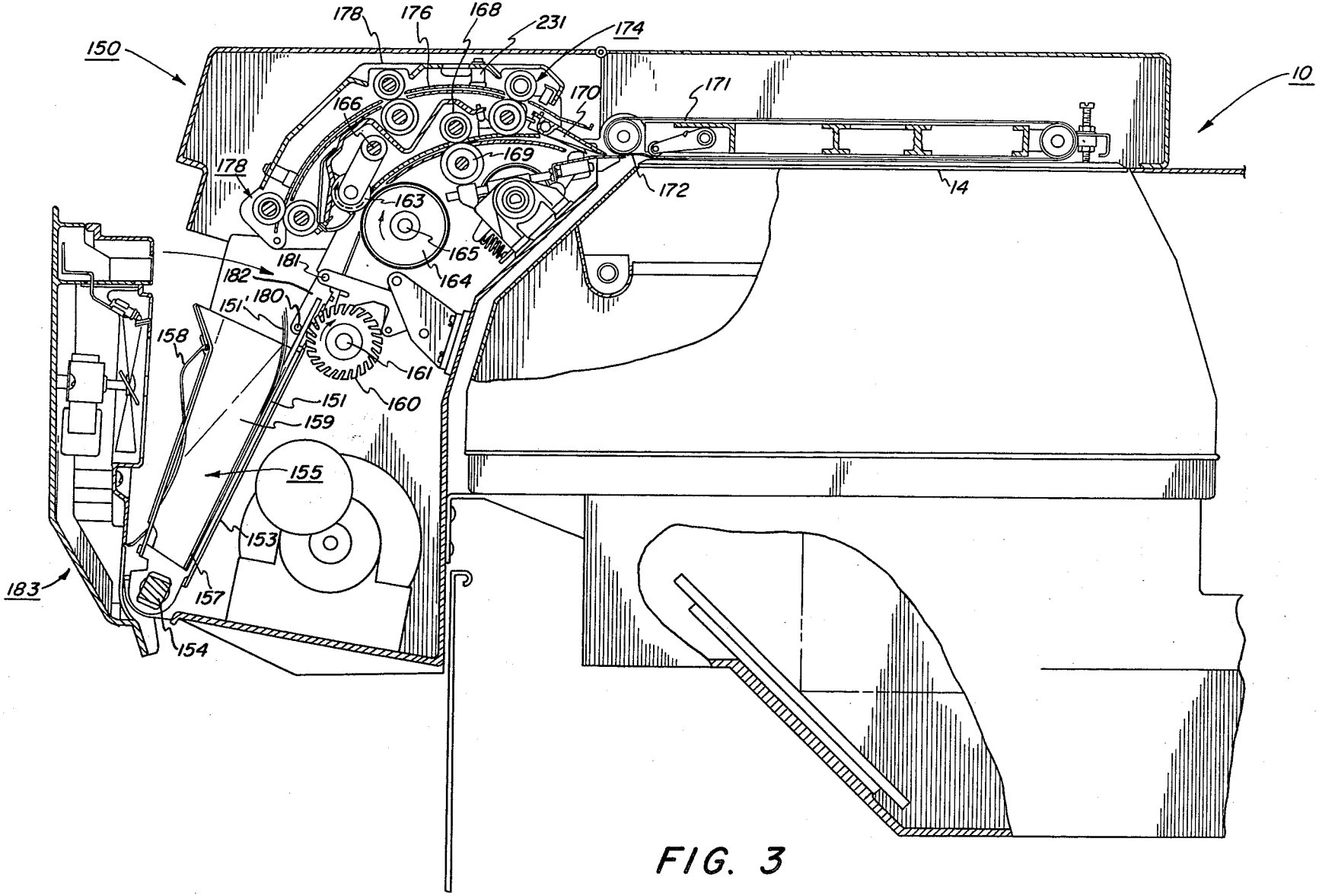
FIG. 3 is an enlarged sectional view of the automatic document handler for the reproduction machine shown in FIG. 1.

In the exemplary arrangement shown, an automatic document handler designated generally by the numeral 150 and seen best in FIG. 3 is provided. As will appear, document handler 150 serves to feed one document at a time from a supply of documents 151 into copying position on platen 14 of copier 10 where a copy or series of copies may be made. Following copying, each document is automatically returned to the document supply 151 and the next document, if any, is brought into copying position on platen 14. As will appear documents returned to supply 151 may be recycled by handler 150 or simply removed by the user when the copying program is completed.

Document handler 150 includes an inclined base section 153, the lower end of which swingably supports by means of shaft 154, matching left and right hand tray members 155. The trays 155 are substantially U-shaped when seen in cross section, each having a base 157, a top 158 spaced thereabove, and sides 159. A portion of the base 157 of each tray member is cut away at the upper end thereof to accommodate primary document feeder roll 160. The trays 155 are adjustable along shaft 154 to accommodate various size documents.

Document feeder roll 160 is rotatably supported under base section 153 on drive shaft 161 such that a portion of the periphery of roll 160 projects into the document tray area, base 153 being suitably apertured to accommodate the roll 160. Feeder roll shaft 161 is suitably supported for rotation and driven by suitable means (not shown) in the direction shown by the solid line arrow of FIG. 3.

A pair of document limiting rolls 163, 164 are disposed on the downstream side of feeder roll 160, rolls 163, 164 functioning to prevent passage of more than one document at a time. Shaft 165 of lower limiting roll 164 is turned in the direction shown by the solid line arrow of FIG. 3. Upper limiting roll 163, which is supported from shaft 166, is arranged to be driven by lower limiting rolls 164 so long as friction developed between rolls 163, 164 remains above a predetermined setting. In the event of a decrease in roll friction, as occasioned by an attempt of two superimposed documents to pass therethrough, the upper roll 163 is turned in a document rejecting direction as shown by the dotted line arrow in FIG. 3 by a suitable drive means (not shown).

Documents emerging from limiting rolls 163, 164 are carried forward by intermediate transport rolls 168, 169 underneath curved document guide fingers 170 to platen transport 171. Transport 171, which may comprise a belt-type conveyor, carries the document onto the platen 14 of copier 10.

A register edge 172 is provided across the inlet side to platen 14, edge 172, serving to register or locate the documents in pre-set position on platen 14 for copying thereof. Platen transport 171 is reversed for this purpose after the document has been carried past register 172, reversal of transport 171 serving to move the document backwards to bring the document trailing edge into abutment with register edge 172. When copying is completed, platen transport 171, is again operated in reverse to carry the document backwards off platen 14, register edge 172 being retracted for this purpose by a suitable means (not shown). The document guide fingers 170 deflect or guide the returning document upwardly into the nip of a first return transport roll pair 174, roll pair 174 carry the returning document between suitable return guides 176 and into the nip of a second return transport roll pair 178 which carry the document back into tray members 155, 156.

To maintain the returned documents, which have been designated for convenience by the numeral 151', segregated from documents 151 awaiting feeding and prevent inadvertent refeeding of returning documents 151' by the primary feeder roll 160 following feed of the last one of the original documents 151, a displaceable bail or separator bar 180 is provided substantially opposite to and above feeder roll 160. Bail 180 is supported from a rockable cross shaft 181. Shaft 181 is suitably journaled in the supporting framework of document handler 150, base section 153 thereof being suitably apertured to permit disposition of the bail support arms 182 therethrough. Suitable means (not shown) are provided to selectively turn cross shaft 181 and raise bail 180 out from under documents 151' resting thereupon and thereafter return bail 180 back onto the topmost one of the documents.

To help guide the returning documents into the document tray, as well as prevent documents from falling out of the tray, particularly when bail 180 is raised a tray cover 183 is provided. Cover 183 is supported on the shaft 154 to enable the cover 183 to be opened for access to the document tray members 155, 156 as when loading or unloading documents.

Referring to the control schematic of FIG. 4*a*, copier 10 is provided with a suitable memory circuit 200 which is programmable for the number of copies to be made. To enable the operator to program memory 200, a keyboard type controller 202 is provided. In addition controller 202 includes selector controls to enable the operator to operate copier 10 alone, or in combination with sorter 100, or in combination with document handler 150, or in combination with both together. It is understood that selecting either or both sorter 100 and/or document handler 150 activates circuits which integrate operation of copier 10 with either or both of these accessories.

A suitable print-start control 201, normally actuably by print button 201$^1$, is provided for operator use. In a schematic representation of FIG. 4*a*, actuation of print button 201$^1$ following setting of copy select memory 200 starts copier 10. It will be understood that copier 10 is assumed to be in a readied condition with paper in either or both main and auxiliary paper trays and the document to be copied on the platen.

Copier 10 stops on completion of the program on signals from comparator circuits 215, 216 as will appear. Additionally, a signal from jam detection circuit 207 stops copier 10. Additional copier stop conditions may be readily envisioned, for example an over temperature condition in the copier fuser.

A counter 209 is provided for counting exposures made, i.e. flashes by the illumination system. A second counter 210 is provided for recording copies completed. Counter 210 is driven by a suitable copy sheet detector 211 at the inlet to the copy tray, sensor 211 generating a pulse as each copy enters the output tray. Second copy sheet detectors 212 are provided for each of the upper and lower bins 105, 106 of sorter 100. Suitable light sources are provided for each of the detectors 211, 212, those for detectors 212 being at the opposite ends of sorter bins 105, 106. Controller 202 includes a suitable selector 214 for selectably activating either detectors 211 or 212 depending on whether or not sorter 100 is used with copier 10.

The output of each counter 209, 210 is compared against the copy program in memory 200 by comparator circuit pair 215, 216, respectively. As the number of copies recorded on counters 209, 210 becomes equal to the number programmed in memory 200, signals from comparator circuits 215, 216 to copier stop circuit 208 shutdown or cycle out in predetermined progression, the various operating components of copier 10 to terminate the copying cycle. At the same time counters 209, 210 may be reset for the next cycle.

Sheet jam detectors 220 are provided at strategic locations along the copy path in copier 10 and at the inlet to sorter 100, detectors serving in association with suitable enabling circuitry to respond to a jam or blockage in the copy sheet path. The signal output of detectors 220 is fed to jam detection circuit 207. Circuit 207, when triggered in response to a jam as detected by one of the detectors 220, shuts down copier 10. To prevent restarting of copier 10 before the jam is cleared, suitable latch or hold circuit 222 is provided. Circuit 222, which is triggered by jam detection circuit 207, controls reset circuit 224 of counter 209. In addition, circuit 222 sets stop circuit 208 to prevent restarting of copier 10 until the jam condition has been corrected as will appear.

Detectors 84, which are provided in each of the paper transports 50, 75, 76, signal opening of the paper guides 54, 83 associated therewith such as would be required to clear jammed paper therefrom. The joint signals from detectors 84 trigger restart circuit 225 which in turn resets hold circuit 222 to permit copier 10 to restart following a paper jam.

Considering operation of copier 10 alone, or with sorter 100, the operator sets memory 200 to the number of copies desired and selects the mode of operation by means of controller 202. The latter sets switch 214 to either include or exclude sorter 100. With a document on the platen, print button 201' may be activated and the copying cycle initiated. As the program progresses, counter 209 tolls each exposure or flash made while counter 210 tolls each copy as it is deposited in the output tray 80, or where sorter 100 is used, in sorter 100.

As will be understood by those skilled in the art, the counts on counters 209, 210 are normally different during the copying cycle, the difference representing the number of copies in process at any one time. In the event a paper jam occurs in copier 10 during the program, the copies in process, i.e. those between the imaging station and output tray 80 or inlet 122 of sorter 100, are considered lost. In clearing the jam, these copy sheets in process, some of which are normally involved in the paper jam, are cleared from the copier 10 and thrown away in preparation for restarting. This is normally done by opening up the guides 54, 63, 83 to paper transports 50, 59, 75, 76, 78 for access to papers trapped or jammed therewithin.

On a jam, the jam detection circuit 207 is triggered by the jam detector or detectors 220 involved. This triggers stop circuit 208 to stop copier 10, and at the same time, actuates hold circuit 222 to prevent restarting of copier 10. Triggering of circuit 222 triggers reset circuit 224 which resets the count on flash counter 209 to the same count as then appearing on copy counter 210.

To clear the jam and restart copier 10, the operator opens and then recloses the paper transport guides 54, 63, 83 to set the detectors. When all of the paper transports have been checked in this fashion, the joint signals of detectors 84 trigger restart circuit 225, releasing hold circuit 222. This permits copier 10 to be restarted by actuation of print button 201'. Copier 10 then resumes copying where it left off, the resetting of counter 209 automatically accommodating the copies lost as a result of the paper jam.

Where document handler 150 is used with copier 10, either alone or with sorter 100, document handler 150 may, in the event of a jam, itself require recycling in order to match the correct document with the first lost or destroyed copy.

Referring to FIG. 4*b*, a document fed counter 230 is provided to count documents as they are returned from platen 14 following copying thereof to document tray 155. For this purpose a suitable detector 231 is provided in the document return path downstream of platen 14. A second counter 233 records documents completed. Counter 233 compares information from memory 200 identifying the number of copies programmed for each document versus signal pulses from either sensor 211 in copy tray 80 or sensor 212 in the inlet to sorter 100 depending on the position of mode selector 214. When coincidence is reached, indicating that the last of the copies programmed for the document being copied have been completed, counter 233 tolls one count. Since the arrival of the last copy in either tray 80 or sorter 100 is always delayed due to the time required to process the copy after the document has been imaged, the document itself is normally back in the document tray 155 by the time counter 233 counts.

The output of counters 230, 233 is fed to a suitable comparator circuit 237, which in turn controls document handler 'ready' and 'not ready' circuits 240, 241, respectively. Circuits 240, 241 enable or prevent restarting of copier 10 following a jam, and in addition control recycling of document handler 150 as will appear.

Comparator circuit 237 is triggered on jam by a signal from jam circuit 207. Circuit 237, when triggered, compares the counts on counters 230, 233. If the counts are the same, indicating that the processing of copies of the last document returned to document tray 151 is completed and therefore the document on platen 14 is correct, circuit 237 actuates ready circuit 240 to place an enabling signal on stop circuit 208. On clearing of the jam as described, circuit 208 is triggered enabling copier 10 to be restarted in the normal fashion. Where, however, the counts on counters 230, 233 differ, indicating that copies of the last document returned to tray 151 are still in process, and therefore are lost, comparator circuit 237 actuates not ready circuit 241.

Triggering of not ready circuit 241 starts document handler 150 to begin recycling the documents therein. At the same time, circuit 241 places a hold signal on stop circuit 208 to prevent operation of copier 10. Recycling of handler 150 continues until the counts on counter 230 matches that on counter 233. This identifies that the correct document is in position on the platen and, in response thereto, comparator circuit 237 renders not ready circuit 241 inoperative to stop document handler 150 while actuating ready circuit 240 to enable copier 10 to be restarted as explained earlier.

To operate copier 10 with document handler 150, controller 202 is set in the document handler mode and the copy select memory 200 is programmed for the number of copies desired. Tray 155 of document handler 150 is loaded with documents to be copied and the tray cover closed. Closure of the tray cover moves, through suitable circuitry (not shown), bail bar 180 from a position below the documents to a position on top of the last document in tray 155. The first document in tray 155 is then advanced to copying position on platen 14 while the next or second document is brought forward to a waiting station adjacent the entrance to platen 14.

The disposition of the first document on platen 14 of copier 10 enables operation of copier 10, and the first copy or copies programmed are made following which the document handler returns that document to tray 155 while placing the waiting second document on platen 14. At this time, the next or third document is brought forward to the waiting station. This process continues until all the documents are copied in accordance with the program in memory circuit 200, following which the copier 10 and the document handler 150 shutdown.

During the copying cycle, counter 230 records each document removed from the platen 14 following completion of the copying thereof. When bail 180 is reset, following return of last document to tray 155, counter 230 is reset to zero. Counter 233 counts documents following completion of the copy processing cycle therefor as determined by signals from either detector 211 in tray 80 or detector 220 in the inlet to sorter 100 relative to the number of copies programmed for each document as established by signals from memory 200.

Where a jam occurs during the copying cycle, the signal generated by the jam circuit 207 shuts down copier 10 in the manner described earlier and at the same time shuts down document handler 150. In addition, the jam signal from circuit 207 actuates comparator circuit 237 and the counts on counters 230, 233 are compared. Where the comparison indicates that the counts on counters 230, 233 are the same, the correct document is in place on platen 14 and comparator circuit 237 actuates ready circuit 240 to allow restarting of copier 10 and resumption of copying cycle when the jam has been cleared.

Where, however, the count on counters 230, 233 is not the same, comparator circuit 237 actuates the not ready circuit 241 which in turn starts document handler 150. At the same time, the signal from circuit 241 to hold circuit 208 precludes restarting of copier 10. Handler 150 recycles the documents until the count on counter 230 equals the count on counter 233. At this point, comparator circuit 237 renders the not ready circuit 241 inoperative and actuates ready circuit 240 to terminate recycling by the document handler 150 while enabling copier 10 to be restarted and the copy program resumed.

Where document handler 150 is not used, the enabling signal requirement of ready circuit 240 to stop circuit 208 is negated by suitable means (not shown).

While the invention has been described with reference to the structure disclosed, it is not confined to the details set forth, but is intended to cover such modifications or changes as may come within the scope of the following claims.

What is claimed is:

1. Means to automatically produce a programmed number of copies in a copying machine in the event a malfunction occurs while the programmed number of copies are being produced which causes the machine to stop prematurely with the result that a not readily discernible number of copies in process within said machine are lost, said machine having a document handling apparatus adapted to automatically present documents to be copied from a document supply to said copying machine to produce the programmed number of copies comprising:

first counter means adapted during machine operation to maintain a running count of copies in process so that in the event of premature stopping of said machine, the number of copies then in process are known;

means to automatically operate said machine in response to said counter means to make up copies lost as a result of said premature stopping to produce the programmed number of copies;

second counter means adapted during machine operation to maintain a running count of documents presented to said copying machine by said document handling apparatus;

third counter means adapted to maintain a running count of the number of documents successfully completely copied by said copying machine;

means to automatically recycle said document handling apparatus to present the document subsequent to the last successfully completed, copied document to said copying machine in the event said document is not in copying position after a premature machine stoppage; and means to inhibit restarting of said machine until said document is in copying position.

2. Means to automatically produce a programmed number of copies in a copying machine according to claim 1 in which said recycle means includes means for distinguishing documents whose processing by said copying machine is completed from documents whose processing is not completed to enable the document associated with the first of said lost copies to be identified.

3. The method of completing a copying program in event of a paper jam occurring in the copying processor while copies are being processed and so avoid the need to start the program over, the steps consisting of:

maintaining a running account of copies completed as the program progresses;

maintaining a running account of copies started as the program progresses;

maintaining a running account of documents imaged;

maintaining a running account of documents whose copying is completed;

stopping the processor in the event of a jam;

resetting the copies started account to the same count as the copies completed account as of the time of said jam so that on restarting of the processor, copies lost as a result of clearing said jam are automatically made up;

comparing said document accounts following a jam to determine if the document in imaging position at the time of said jam is the correct document for resumption of the copying program; and restarting the copy processor to continue the copying program when the correct document is in imaging position.

4. The method according to claim 3 including the step of removing the document in imaging position at the time of said jam and replacing the document with said correct document in the event the wrong document is in imaging position following said jam.

5. The method of claim 3 including the step preventing continuation of said copying program until the correct document is in copying position.

6. Means to automatically produce a programmed number of copies in a copying machine in the event a malfunction occurs while the program is being performed which causes the machine to stop prematurely with the result that a not readily discernible number of copies in process within said machine are lost, said machine having a document handling apparatus adapted to automatically present documents to be copied from a document supply to said copying machine in accordance with said program comprising:

a first counter to count copies whose processing is completed, and a second counter to count the number of document exposures by said copying machine, the difference between the count of said first and second counters comprising the number of copies in process so that in the event of a premature stopping of said machine, the number of copies then in process are known;

means to reset said second counter to the same count as said first counter to automatically program into said machine provision for making up lost copies when said machine is restarted;

third counter means adapted during machine operation to maintain a running count of documents presented to said copying machine by said document handling apparatus;

fourth counter means adapted to maintain a running count of the number of documents successfully completely copied by said copying machine;

means to automatically recycle said document handling apparatus to present the document subsequent to the last successfully completed, copied document to said copying machine in the event said document is not in copying position after a premature machine stoppage; and, means to inhibit restarting of said machine until said document is in copying position.

* * * * *